US005678445A

United States Patent [19]

Schultz

[11] Patent Number: 5,678,445

[45] Date of Patent: Oct. 21, 1997

[54] APPARATUS FOR NECKING CAN BODIES

[75] Inventor: Robert H. Schultz, Golden, Colo.

[73] Assignee: Coors Brewing Company, Golden, Colo.

[21] Appl. No.: 640,508

[22] Filed: May 1, 1996

[51] Int. Cl.[6] ..... B21D 22/00; B21D 22/21

[52] U.S. Cl. ..... 72/352; 413/69; 72/348

[58] Field of Search ..... 72/344, 345, 348, 72/349, 352; 413/76, 69

[56] References Cited

U.S. PATENT DOCUMENTS

| | | | |
|---|---|---|---|
| 3,687,098 | 8/1972 | Maytag | 72/354 |
| 3,797,429 | 3/1974 | Wolfe | 72/352 |
| 3,812,696 | 5/1974 | Kneusel et al. | 72/352 |
| 4,446,714 | 5/1984 | Cvacho | 72/348 |
| 5,056,350 | 10/1991 | Moen et al. | 72/345 |
| 5,249,449 | 10/1993 | Lee et al. | 72/352 |

*Primary Examiner*—Lowell A. Larson
*Assistant Examiner*—Rodney A. Butler
*Attorney, Agent, or Firm*—Klaas, Law, O'Meara & Malkin, P.C.; Joseph J. Kelly

[57] ABSTRACT

An improvement in necking apparatus for forming a necked end on a can body wherein during the necking operation pressurized air moves into the interior of a can body being necked through an open end portion of a conduit in a knock out ram which knock out ram is reciprocally mounted in the necking die and wherein valve means are provided to control the amount of pressurized air flowing out through the open end portion and to retain the pressurized air in the conduit after the necking operation has been completed.

6 Claims, 1 Drawing Sheet

APPARATUS FOR NECKING CAN BODIES

FIELD OF THE INVENTION

This invention relates generally to apparatus for use in forming a necked end on a can body and more particularly to apparatus for controlling the flow of pressurized air used in the apparatus for forming a necked end on a can body.

BACKGROUND OF THE INVENTION

There are many types of apparatus used in the formation of a necked end on a can body. One such type of apparatus is disclosed in U.S. Pat. No. 3,687,098 issued to J. H. Maytag, which patent is incorporated herein by reference thereto. In this patent a plurality of spaced apart circumferentially extending necking dies are fixedly mounted on a rotatable mandrel for rotation therewith. A reciprocable knock out means comprising a punch and a ram are mounted in each of the necking dies and are reciprocated by a conventional cam and cam followers. Each knock out punch has a conduit extending through it at least a portion of the knock out means have a conduit extending therethrough and one end of the conduit is connected to connecting means which connecting means extends between the one end of the conduit and a manifold having air under pressure contained therein. During the necking operation, pressurized air flows from the manifold through the connecting means and the conduit into the interior of the can body being necked to retain the integrity of the can body. In the apparatus of the '098 patent, and other similar apparatus, the necking operation is completed during a revolution of about 180 degrees by the mandrel. Therefore, the connecting means are only connected to the manifold during the 180 degrees. After this amount of rotation, the pressurized air in the connecting means and the conduit is released to atmosphere. Since most necking machines neck can bodies at the rate of 2400 can bodies per minute, this is a tremendous amount of wasted pressurized air. Therefore, there exists a need to avoid this wasted pressurized air.

BRIEF DESCRIPTION OF THE INVENTION

This invention provides the conduit in the knock out means of a necking apparatus with valve means so that pressurized air in the conduit may be provided to the interior of a can body only when needed during the operation but retains the pressurized air in the conduit when the pressurized air is not needed for the interior of a can body. Also, the conduit is continuously connected to a manifold of pressurized air during all revolutions of the mandrel of the necking apparatus.

In a preferred embodiment, the invention is directed to necking apparatus for providing a necked end on a can body in which pressurized air is supplied to the interior of the can body during the necking operation. In this type of apparatus, a plurality of circumferentially spaced apart necking dies are fixedly mounted on a mandrel which mandrel is mounted for continuous rotation. Knock out means comprising a punch and a ram are is mounted in each necking die for reciprocating movement relative thereto. At least a portion of each knock out means, preferably the knock out ram, has a conduit extending therethrough and the conduit has at least one open end facing the interior of the can body being necked. Valve means are associated with the conduit for controlling the flow of pressurized air through the at least one open end of the conduit only when needed. Connecting means are provided for continuously connecting each conduit to a source of pressurized air during the rotation of the mandrel.

In one preferred embodiment of the invention, the valve means comprise a valve stem having an elongated body portion and an enlarged head portion. Mounting means are provided for mounting the elongated body portion, and the enlarged head portion, at a fixed location on the necking die. At least a portion of the elongated body portion is located in a first portion of the conduit. An end portion of the elongated body portion is secured to the mounting means. An annular passageway is formed between another portion of the elongated body portion and a second portion of the conduit for permitting the flow of pressurized air through the annular passageway and out through the open end portion. The knock out ram also has radially extending passageway formed therein which passageway has one open end in fluid communication with the annular passageway. The radially extending passageway is connected to the connecting means so that pressurized air may flow through the radially extending passageway and the annular passageway and the open end into the interior of said can body being necked. Sealing means are provided between the at least a portion of the elongated body portion and the first portion of the conduit for preventing flow of the pressurized air from the radially extending passageway toward the mounting means. The open end of the conduit and the enlarged head portion have mating sealing surfaces. Therefore, as the knock out ram moves relative to the elongated body portion and the head portion thereof, the enlarged head portion moves out of or into sealing engagement with the open end portion of the conduit to permit or prevent passage of the pressurized air through the open end of the conduit. The first and second portions of the conduit have generally cylindrical inner surfaces wherein the generally cylindrical surface of the second portion has a diameter greater than the diameter of the generally cylindrical surface of the first portion.

In another preferred embodiment of the invention, the necking die has annular sidewall having a longitudinal axis extending in a direction parallel to the direction of the reciprocal motion of the knock means. The annular sidewall has an elongated opening formed therein which elongated opening extends in the same direction as the longitudinal axis. The valve means are secured to the knock means preferably the knock out ram, for movement therewith and have a portion thereof passing through the elongated opening. The valve means have a movable portion for permitting or preventing flow of the pressurized air through the conduit. Actuator means are provided for moving the movable portion to a position to permit or prevent the flow of pressurized air through the conduit. the actuator means comprise a cam and resilient means for urging the movable portion against the cam.

BRIEF DESCRIPTION OF THE DRAWINGS

Preferred embodiments of the invention are illustrated in the drawing in which.

DETAILED DESCRIPTION OF THE INVENTION

Figure 1:
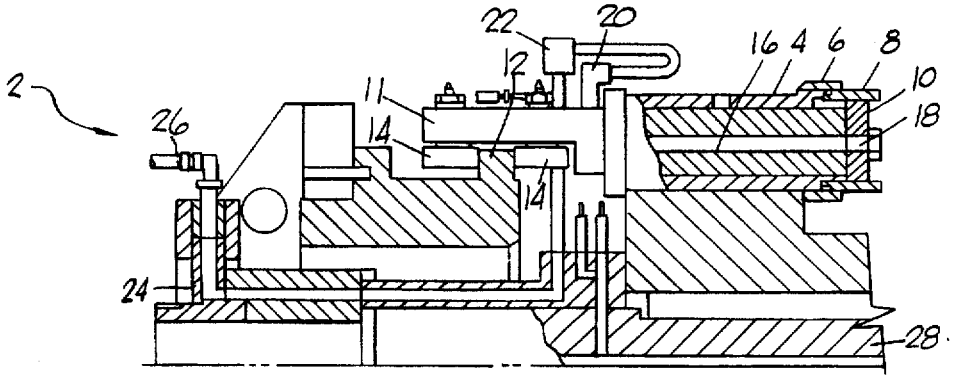
FIG. 1 (PRIOR ART)
FIG. 1 is side elevational view with parts in section of a portion of a necking apparatus of the prior art.

In FIG. 1, there is illustrated a portion of a necking apparatus 2 of the prior art such as the necking apparatus in the '098 patent. The principal parts of the necking apparatus 2 include a stationary bushing 4, which is one of a plurality of circumferentially spaced apart bushings, a retaining nut 6 and a stationary necking die 8. Knock out means, comprising a knock out punch 10 and a knock out ram 11 are mounted for reciprocal sliding movement in the bushing 4 and are reciprocated by the cam 12 and cam followers 14. The knock out punch 10 and ram 11 have a hollow conduit 16 passing therethrough which hollow conduit 16 has an open end 18. The other end is connected by elbow means 20 to conventional connecting means 22 which connect the other end to an air manifold 24 having pressurized air contained therein. The air manifold 24 has conventional fittings 26 for connecting the air manifold 24 to a source of pressurized air (not shown). The above necking apparatus is mounted on a rotatable mandrel 28 which is rotated by suitable means (not shown). The necking apparatus 2, in relation to the provision of pressurized air to the interior of the can body, operates as explained above.

Figure 2:
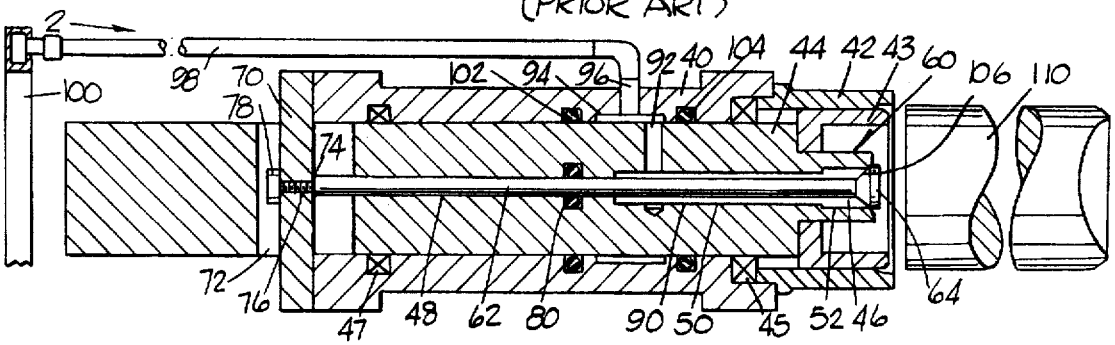
FIG. 2 is a side elevational view with parts in section of a portion of a preferred embodiment of a necking apparatus of this invention with a valve in a closed position.
Figure 3:
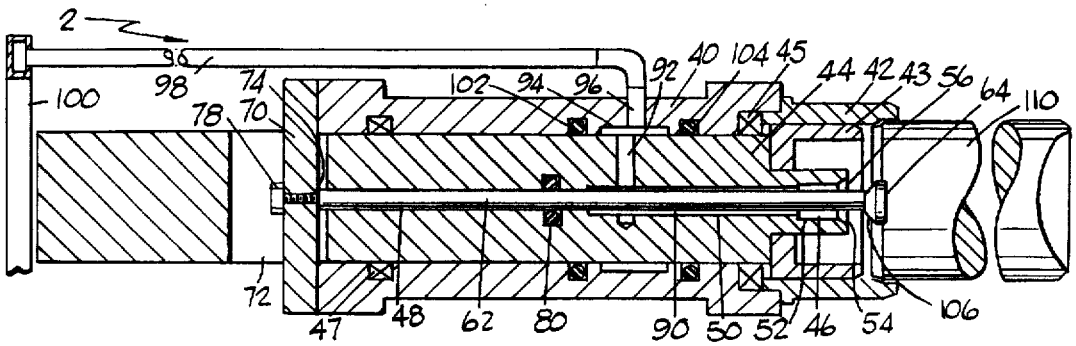
FIG. 3 is a side elevational view similar to FIG. 2 with the valve in an opened position.

In FIGS. 2 and 3, there is illustrated one preferred embodiment of the invention. A stationary bushing 40 is mounted on a conventional rotating mandrel (not shown) and is one of a plurality of circumferentially spaced apart bushings mounted on the mandrel at fixed locations. A necking die 42 is secured to the bushing 40. A knock out punch 43 and a knock out ram 44 are mounted on spaced grease seals 45 and 47 for reciprocal sliding movement in each of the bushings 40. The knock out punch is secured to the knock out ram 44 by suitable securing means such as those illustrated in FIG. 4. The knock out punch 43 and ram 44 are reciprocated by a conventional cam and cam followers (not shown) such as in the '098 patent. A conduit 46 extends in a longitudinal direction through the knock out ram 44 and has first portion 48 having a generally cylindrical inner surface; a second portion 50 having a generally cylindrical inner surface having a diameter greater than the diameter of the generally cylindrical inner surface of the first portion 48 and a third portion 52 having a generally cylindrical inner surface having a diameter greater than the diameter of the generally cylindrical inner surface of the second portion 50. The third portion 52 has a generally conical inner surface 54 (FIG. 3) leading to the open end portion 56.

Valve means 60 are provided for opening or closing the open end portion 56. The valve means comprise a stem portion having an elongated body portion 62 and an enlarged head portion 64.

A fixed support bar 70 is secured to the bushing 40 by suitable conventional means (not shown) and passes through an elongated slot 72 formed in the knock out ram 44. A portion of the elongated body portion 62 passes through the first portion 48 of the conduit 46 and has a shoulder portion 74 that abuts against the support bar 70. A threaded portion 76 integral with the elongated body portion 62 passes through an opening in the support bar 70 and is secured thereto by a threaded nut 78. If desired, a support for the elongated body portion 62 can be mounted in the third portion 52. The support would be provided with axially extending passageways to permit the flow of air therethrough and out of the open end portion 56. Sealing means 80, such as an o-ring, form an effective seal between the first portion 48 and the elongated body portion 62 for purposes described below.

An annular passageway 90 is formed between the second portion 50 of the conduit 46 and the elongated body portion 62. A radially extending passageway 92 is formed in the knock out ram 44 and has one open end in fluid communication with the annular passageway 90. An elongated annular recess 94 is formed in the bushing 40 and is in fluid communication with another open end of the radially extending passageway 92 during the complete reciprocating motion of the knock out punch 44. A radially extending passageway 96 is formed in the bushing 40 and has one open end thereof in fluid communication with the elongated annular recess 94. The other end of the radially extending passageway 96 is connected to connecting means 98 which continuously connect the radially extending passageway 96 to an annular air manifold 100 by conventional means at all times during the revolution of the mandrel. Sealing means 102 and 104, such as o-rings, form an effective seal between the bushing 40 and the knock out ram 44 on each axial side of the elongated annular recess 94. The enlarged head portion 64 has a generally conical surface 106 for mating sealing engagement with the generally conical surface 54.

The operation of the invention is illustrated in FIGS. 2 and 3. As illustrated in FIG. 2, the can body 110 is approaching the open end of the necking die 42. The knock out ram 44 is in its forward position so that the generally conical surfaces 54 and 106 are in sealing engagement. The radially extending passageway 96 is in fluid communication with the pressurized air in the air manifold 100 but no pressurized air is flowing out of the open end portion 56 because of the effective seal formed by the generally conical surfaces 54 and 106. In FIG. 3, the can body 110 has moved into the necking die 42. The knock out punch 44 has been moved to its rearward position so that the generally conical surfaces 54 and 106 are spaced apart. This arrangement permits pressurized air to flow from the air manifold 100 through the connecting means 98, the radially extending passageway 96, the elongated annular recess 94, the radially extending passageway 92, the annular passageway 90 and out through the open end portion 56 into the interior of the can body 110. The movement of the knock out ram 44 is controlled so that the space between the conical surfaces 54 and 106 can be varied to control the amount of pressurized air flowing out of the open end portion 56. After the can body 110 has been necked, the apparatus returns to the positions illustrated in FIG. 2 so that none of the pressurized air in the annular passageway 90, the radially extending passageway 92, the elongated annular recess 94, the radially extending passageway 96 and the connecting means 98 is lost or wasted.

Figure 4:
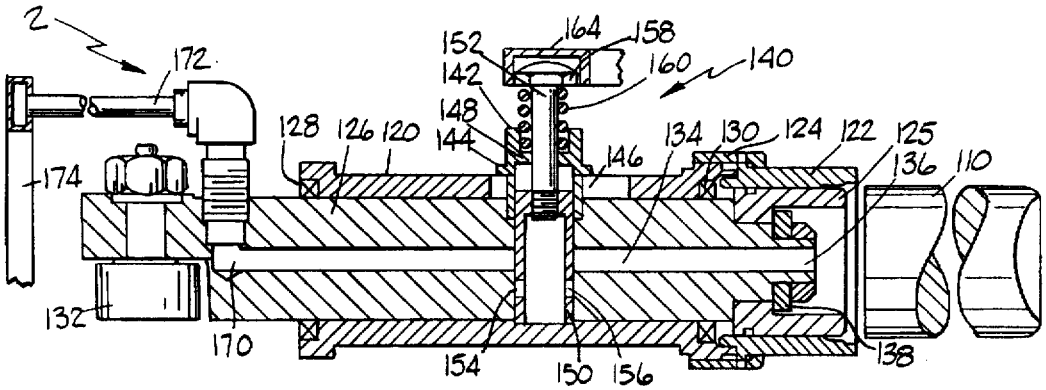
FIG. 4 is a side elevational view with parts in section of another preferred embodiment of a necking apparatus of this invention with a valve in a closed position.

In FIG. 4, there is illustrated another preferred embodiment of the invention. A stationary bushing 120 is mounted on a conventional rotating mandrel (not shown) and is one of a plurality of circumferentially spaced apart bushings mounted on the mandrel at fixed locations. A necking die 122 is secured to the bushing 120 by a conventional clamp 124. A knock out punch 125 and a knock out ram 126 are mounted for reciprocal sliding movement on spaced apart bearing 128 and 130 and are reciprocated by a conventional cam (not shown) and a cam follower 132. A conduit 134 is formed in the knock out ram 126 and extends in a longitudinal direction and has an open end portion 136. Securing means 138 secure the knock out punch 125 to the knock out ram 126.

Valve means 140 are provided for opening or closing the conduit 134. The valve means 140 have a body portion 142 having an external flange portion 144 for sliding movement over the outer surface of the bushing 120. The body portion 142 extends through an elongated longitudinally extending slot 146 in the bushing 120. Rotation preventing means between the body portion 142 and the elongated slot 146 can be accomplished by any conventional suitable means (not shown) such as giving each a rectangular configuration. The body portion 142 has an inwardly projecting flange 148 for a purpose described below.

The valve means 140 also comprise a movable member comprising a lower portion 150 and an upper portion 152 which are threadedly connected together and mounted for relative sliding movement in the body portion 142. Suitable means (not shown), such as a groove in the outer surface of the lower portion 150 and a pin on the inner surface of the body portion 142, prevent rotational movement between the moveable member and the body portion 142. Opposite aligned openings 154 and 156 are formed in the lower member 150 for purposes described below. The upper portion 152 has an enlarged head portion 158. Resilient means 160, such as a coiled spring, are located between and in contact with the enlarged head portion 158 and the inwardly projecting flange 148 to urge the enlarged head portion 158 into contact with a cam 164 for purposes described below. It is understood that other types of valve means may be substituted for the valve means 140. For example, the lower portion 150 can be fixed to the body portion 142 for movement therewith so that the opposite openings 154 and 156 are always aligned with the conduit 134. A closure member would then be attached to the upper position 152 for movement with the upper portion 152 and through the lower portion 150 to close the opposite openings 154 and 156.

The other end 170 of the conduit 130 is connected to connecting means 172 which are continuously connected by conventional means to an annular air manifold 174 containing air under pressure so that the other end 170 of the conduit 130 is at all times during the revolution of the mandrel in fluid communication with pressurized air.

In FIG. 4, the necking apparatus 2 is illustrated in the closed position as the can body 110 is being moved toward the necking die 122. The cam 164 has moved the upper portion 152 and the lower portion 150 downwardly against the force of the resilient means 160 so that the opposite openings 154 and 156 are not in alignment with the conduit 134 so that no pressurized air is flowing out of the open end portion 136. As the can body 110 moves into the necking die 122, the cam 164 is at a new location that allows the upper portion 152 and the lower portion 150 to move upwardly until the opposite aligned openings 154 and 156 are in alignment with the conduit 134. This permits pressurized air to flow out of the air manifold 174, through the connecting means 172, the other end portion 170, the conduit 134 and out through the open end portion 136 into the interior of the can body 110. The movement of the lower portion 150 is controlled by the location of the cam 164 so that the portion of the opening 154 and 156 in alignment with the conduit 134 can be varied to control the amount of pressurized air flowing out of the open end portion 136. After the necking operation has been completed, the cam 164 moves the upper portion 152 and the lower portion 150 downwardly until the opposite aligned openings 154 and 156 are not in alignment with the conduit 134 so that no pressurized air is flowing out through the open end portion 136.

It is contemplated that the inventive concepts herein described may be variously otherwise embodied and it is intended that the appended claims be construed to include alternative embodiments of the invention except insofar as limited by the prior art.

What is claimed is:

1. In apparatus for providing pressurized air to the interior of a can body during the necking thereof wherein such apparatus includes a rotating mandrel having a plurality of circumferentially spaced apart relatively stationary necking dies mounted thereon for rotation therewith and wherein reciprocating knock out means comprising a punch and a ram are mounted for relative sliding movement in each necking die and wherein at least a portion of each knock out means has a conduit extending therethrough having an open end portion through which pressurized air from a source of pressurized air flows through the conduit into the interior of the can body during the necking operation, the improvement comprising:

connecting apparatus for continuously connecting said conduit to a source of pressurized air during the rotation of said mandrel;

valve apparatus associated with said conduit for controlling the flow of said pressurized air so that pressurized air flows from said conduit into the interior of said can body only during said necking operation;

at least a portion of said valve apparatus moving with said knock out means; and wherein said valve apparatus comprises:

a valve stem having an elongated body portion and an enlarged head portion;

mounting means for mounting said elongated body portion and said enlarged head portion at a fixed location on said necking die so that said enlarged head portion never contacts said can body;

at least a portion of said elongated body portion being located in a first portion of said conduit;

said elongated body portion having an end portion secured to said mounting means;

an annular passageway between another portion of said elongated body portion and a second portion of said conduit for permitting the flow of pressurized air through said annular passageway and out through said open end portion;

at least a portion of said knock out means having a radially extending passageway formed therein and having one open end in fluid communication with said annular passageway;

said radially extending passageway being connected to said connecting means so that pressurized air may flow through said radially extending passageway and said annular passageway and said open end portion into the interior of said can body being necked;

sealing means between said at least a portion of said elongated body portion and said first portion of said conduit for preventing flow of said pressurized air from said radially extending passageway toward said mounting means; and said enlarged head portion being located relative to said open end portion so that as said knock means move relative to said enlarged head portion said enlarged head portion opens or closes said open end portion of said conduit is opened or closed.

2. Apparatus as in claim 1 wherein:

said at least a portion of said knock out means comprising said knock out ram; and said open end portion of said conduit and said enlarged head portion have mating sealing surfaces.

3. Apparatus as in claim 2 wherein:

said first and second portions of said conduit have generally cylindrical inner surfaces; and said generally cylindrical surface of said second portion having a diameter greater than the diameter of said generally cylindrical surface of said first portion.

4. In apparatus for providing pressurized air to the interior of a can body during the necking thereof wherein such apparatus includes a rotating mandrel having a plurality of circumferentially spaced apart relatively stationary necking dies mounted thereon for rotation therewith and wherein reciprocating knock out means comprising a punch and a ram are mounted for relative sliding movement in each necking die and wherein at least a portion of each knock out means has a conduit extending therethrough having an open end portion through which pressurized air from a source of pressurized air flows through the conduit into the interior of the can body during the necking operation, the improvement comprising:

connecting apparatus for continuously connecting said conduit to a source of pressurized air during the rotation of said mandrel;

valve apparatus associated with said conduit for controlling the flow of said pressurized air so that pressurized air flows from said conduit into the interior of said can body only during said necking operation;

at least a portion of said valve apparatus moving with said knock out means;

wherein said valve apparatus comprises:

said necking die having an annular sidewall having a longitudinal axis extending in a direction parallel to the direction of the reciprocal motion of said knock out means;

said annular sidewall having an elongated opening formed therein, said elongated opening extending in the same direction as said longitudinal axis;

said valve apparatus secured to said knock out ram for movement therewith and having a first portion thereof passing through said elongated opening; and said valve apparatus having a movable second portion for controlling the flow of said pressurized air through said conduit and out of said open end portion.

5. Apparatus as in claim 4 and further comprising:

actuating apparatus for moving said movable second portion to a position to permit or prevent the flow of pressurized air through said conduit.

6. Apparatus as in claim 5 wherein said actuating apparatus comprises:

a cam mounted at a location spaced from said rotating mandrel; and resilient means urging said second portion against said cam.

* * * * *